US007865968B2

(12) United States Patent
Lilenthal et al.

(10) Patent No.: US 7,865,968 B2
(45) Date of Patent: Jan. 11, 2011

(54) HEAD SUSPENSION SYSTEM AND HEADGEAR THAT HAVE AN ADJUSTABLE VISOR AND METHOD OF ADJUSTING SAME

(75) Inventors: Niklas Lilenthal, Djura (SE); Jonas D. Fridholm, Ekero (SE)

(73) Assignee: 3M Innovative Properties Company, St. Paul, MN (US)

( * ) Notice: Subject to any disclaimer, the term of this patent is extended or adjusted under 35 U.S.C. 154(b) by 1303 days.

(21) Appl. No.: 11/379,144

(22) Filed: Apr. 18, 2006

(65) Prior Publication Data

US 2007/0245467 A1 Oct. 25, 2007

(51) Int. Cl.
*A61F 9/06* (2006.01)

(52) U.S. Cl. ..... 2/8.2

(58) Field of Classification Search ..... 2/426, 2/427, 431, 432, 435–439, 442–450, 452, 2/2.5, 9, 10, 8.2

See application file for complete search history.

(56) References Cited

U.S. PATENT DOCUMENTS

| | | | | |
|---|---|---|---|---|
| 1,601,830 | A * | 10/1926 | Huntsman | 2/8.2 |
| 1,885,426 | A * | 11/1932 | Flood | 2/8.2 |
| 2,418,334 | A * | 4/1947 | Coccellato | 2/8.2 |
| 2,445,355 | A * | 7/1948 | Hurt | 2/10 |
| 3,500,474 | A | 3/1970 | Austin | |
| 3,727,235 | A * | 4/1973 | Fisher | 2/10 |
| 4,802,243 | A * | 2/1989 | Griffiths | 2/422 |
| 4,888,831 | A | 12/1989 | Oleson | |
| 4,942,628 | A | 7/1990 | Freund | |
| 4,986,282 | A * | 1/1991 | Stackhouse et al. | 128/857 |
| 5,077,836 | A | 1/1992 | Idoff et al. | |
| 5,086,515 | A * | 2/1992 | Giuliano | 2/8.1 |
| 5,337,419 | A | 8/1994 | Russell | |

(Continued)

FOREIGN PATENT DOCUMENTS

KR 1996-0008225 8/1996

(Continued)

OTHER PUBLICATIONS

"Optrel Galaxy Welding Helmet" , Western Safety Products, Inc., Seattle, Washington, USA [on line], retrieved from internet on Apr. 7, 2006, <http://www.westernsafety.com/optrelwelding/optrelweldingpg1.html>.

(Continued)

*Primary Examiner*—Tejash Patel
(74) *Attorney, Agent, or Firm*—Anna A. Wetzels

(57) ABSTRACT

Headgear adapted to protect a wearer having a visor and a flexible circumferential band adapted to be supported by a head of the wearer. A mounting attachment attaches the visor to the flexible circumferential band at each of two side attachment locations with the visor generally positioned in front of a face of the wearer. The mounting attachment has a slide channel associated with the flexible circumferential band and a slide associated with the visor. The slide is able to slide forward and aft in the slide channel with respect to the face of the wearer and is selectively securable in a plurality of forward and aft positions. This allows the visor to be adjusted inwardly and outwardly with respect to the face of the wearer.

21 Claims, 6 Drawing Sheets

U.S. PATENT DOCUMENTS

| | | | | |
|---|---|---|---|---|
| 5,571,217 | A | | 11/1996 | Del Bon et al. |
| 5,608,917 | A | | 3/1997 | Landis et al. |
| 5,673,431 | A | * | 10/1997 | Batty ..... 2/9 |
| 5,896,586 | A | | 4/1999 | Freund |
| 6,341,382 | B1 | | 1/2002 | Ryvin et al. |
| 7,007,306 | B2 | | 3/2006 | Howard et al. |
| 2006/0080761 | A1 | | 4/2006 | Huh |

FOREIGN PATENT DOCUMENTS

| | | |
|---|---|---|
| WO | WO 95/20886 | 8/1995 |

OTHER PUBLICATIONS

U.S. Appl. No. 11/379,140, filed Apr. 18, 2006 to Lilenthal et al. entitled *Head Suspension System and Headgear With Replaceable Headband Bridge and Method of Adjusting Same*.

* cited by examiner

HEAD SUSPENSION SYSTEM AND HEADGEAR THAT HAVE AN ADJUSTABLE VISOR AND METHOD OF ADJUSTING SAME

The present invention relates generally to head suspension systems and headgear and, particularly, such head suspension systems and headgear with adjustments in size or configuration and methods of adjusting or configuring head suspension systems.

BACKGROUND

Protective helmets, particularly welding helmets, tend to be heavy and cumbersome. The weight of a protective helmet can be burdensome on a wearer who may often already be working in extreme conditions of heat and other adverse elements. The weight of the protective helmet adds further to that burden.

A head suspension system for a protective helmet must be adjusted to the particular requirements of the wearer for the helmet to be comfortable. An ill fitting helmet, especially one that is heavy, may be extremely uncomfortable for a wearer, which could lead to operating mistakes and, possibly, injury.

Adjustment mechanisms on conventional protective helmets, such as welding helmets, are typically either bulky, difficult to adjust, or both. Adjustment mechanisms that require a bulky adjustment knob can add a considerable weight to the protective helmet. Common adjustment mechanisms may also involve removable and replaceable bolts or set screws that can be very difficult to adjust. Bolts that must be undone often lead to a multiplicity of loose bolts, nuts and washers that may be difficult to reassemble. This can be especially true when the wearer is wearing protective hand gear such as gloves.

Some head suspension systems may be adjusted by repositioning straps. One example of a head suspension adjustment mechanism adjusted by repositioning a headband strap is disclosed in U.S. Pat. No. 5,608,917, Landis et al, Ergonomic Head Band Apparatus. An ergonomic head band includes a strap having first and second upwardly curved side arcuate segments, a front arcuate region and tails which couple together at the back of a wearer's head. The tails are repositionable on each other providing a common sizing adjustment. Face shields or other apparatus may be coupled to the head band.

Other headgear supports provide adjustability with headbands with ends that slide relatively to each other. Examples are found in U.S. Pat. No. 3,500,474, Austin, Adjustable Headband; U.S. Pat. No. 4,888,831, Oleson, Adjustable Head Band Suspension System For Use With Hard Hat Shell, providing a slidably disposed adjusting device; U.S. Pat. No. 5,896,586, Freund, Adjustable Headband Having a Resiliently Bowable Fastener Surface, having a plurality of longitudinally spaced slots and a resilient fastener with a channel to slidably receive the end with the spaced slots; and U.S. Pat. No. 6,341,382, Ryvin et al, One-Piece Adjustable Headgear Support, having an integrally formed slidable adjustment mechanism. However, such adjustment mechanisms are not always easy for a wearer in the field to adjust and may add unnecessary weight to the protective helmet.

U.S. Pat. No. 5,077,836, Idoff et al, Headgear, discloses a headgear for mounting protective equipment such as a visor. The head band includes a brow band section, side band section and a neck band section. The neck band portion includes an adjustment mechanism including slidable portions secured with a knob. In addition, the brow section includes an adjustable buckle. Again, the adjustment mechanism can be unduly difficult for a user to adjust and may add unnecessary weight to the headgear.

U.S. Pat. No. 4,942,628, Freund, Helmet Suspension Having Ratchet Adjustment, discloses a head protection or helmet suspension having a ratchet adjustment for the adjustment of the head suspension in size. An adjustment knob engages pins in the ratchet case to lock the head suspension size in position. The adjustment knob and ratcheting mechanism may add unnecessary weight to the helmet.

U.S. Pat. No. 5,571,217, Del Bon et al, Protective Assembly For The Protection Of The Human Head, discloses a protective assembly which has a circular support structure adapted to be connected to the head of the person wearing the protective assembly. A protective visor is pivotally connected to the support structure to be swiveled for a lower operating position and to an upper resting position. Mechanisms and an actuating member are provided for adjusting and fixing the position of the visor in the viewing direction and in the lower operating position. Forward and aft adjustment of visor is provided with removable set screws and mounting lugs. Forward and aft adjustment is achieved by releasing the set screws and reinserting the set screws in a different mounting hole location. The releasing and reinsertion of set screws can be a cumbersome and difficult process to accomplish, especially by a worker in the field under already difficult conditions.

U.S. Pat. No. 7,007,306, Howard et al, Face Shield Assembly, discloses a face shield assembly including a frame and a removable protective element supported by the frame. The frame is pivotally supported on a support structure such that the frame can be moved between an upper (out of use) and a lower (in use) position. The frame may be selectively spaced relative to the user's head by removing and replacing a mounting bolt into a different mounting hole location. Again, removing and replacing a mounting bolt can be a cumbersome and difficult process to accomplish.

The Optrel™ Galaxy™ welding helmet also has a tilting and telescoping headgear allowing adjustment of the helmet position from the face and chin. However, no disclosure is provided on the mechanism to achieve a tilting and telescoping headgear allowing such adjustment of the helmet position from the face and chin of the wearer.

SUMMARY

The present invention provides a head suspension system, headgear and method of adjusting visor associated with a headgear that is lightweight and easily adjustable, even while being worn by the wearer. The visor may be adjusted inwardly and/or outwardly, i.e., aft or forward, respectively, by lifting and sliding a movable resilient tab and allowing the resilient tab to engage one of a plurality of securing holes on or associated with the headband.

In an embodiment, the present invention provides a headgear adapted to protect a wearer having a visor and a flexible circumferential band adapted to be supported by a head of the wearer. A mounting attachment attaches the visor to the flexible circumferential band at each of two side attachment locations with the visor generally positioned in front of a face of the wearer. The mounting attachment has a slide channel associated with a first headgear part and a slide associated with a second headgear part. The slide is able to slide forward and aft in the slide channel with respect to the face of the wearer and is selectively securable in a plurality of forward and aft positions. This allows the visor to be adjusted inwardly and outwardly with respect to the face of the wearer.

In an embodiment, the present invention provides a head suspension system for a headgear having a visor adapted to protect a wearer. A flexible circumferential band is adapted to be supported by a head of the wearer. A mounting attachment attaches the visor to the flexible circumferential band at each of two side attachment locations with the visor generally positioned in front of a face of the wearer. The mounting attachment has a slide channel associated with a first headgear part and a slide associated with a second headgear part. The slide is able to slide forward and aft in the slide channel with respect to the face of the wearer and is selectively securable in a plurality of forward and aft positions. This allows the visor to be adjusted inwardly and outwardly with respect to the face of the wearer.

In an embodiment, the first headgear part is the circumferential band and the second headgear part is the visor.

In an embodiment, the visor may be adjusted by the wearer inwardly and outwardly with respect to the face of the wearer while the headgear is being worn by the wearer.

In an embodiment, the mounting attachment has a resiliently biased tab having a projection on one of the slide and the slide channel and another of the slide and the slide channel having a plurality of mating holes such that the slide may be adjustably secured in a plurality of forward and aft locations.

In an embodiment, the resiliently biased tab is resiliently biased toward a mating of the tab and one of plurality of mating holes.

In an embodiment, the tab is liftable and the slide is adjustable by the wearer while the headgear is being worn by the wearer.

In an embodiment, the present invention provides a method of adjusting a position of a visor associated with headgear adapted to protect a wearer, the headgear having a mounting attachment for the visor to a head suspension system, the mounting attachment having a slide channel associated with a first headgear part, a slide associated with a second headgear part, the slide being able to slide forward and aft in the slide channel with respect to the face of the wearer, the slide being selectively secured in a plurality of forward and aft positions whereby the visor may be adjusted inwardly and outwardly with respect to the face of the wearer. A tab associated with the slide is released. The slide is slid with respect to the slide channel using the tab. The slide is selectively secured in one of a plurality of forward and aft positions by releasing the tab.

In an embodiment, the first headgear part is the circumferential band and the second headgear part is the visor.

In an embodiment, the sliding step may be accomplished while the headgear is being worn by the wearer.

In an embodiment, the mounting attachment has a resiliently biased tab having a projection on one of the slide and the slide channel and another of the slide and the slide channel having a plurality of mating holes such that the slide may be adjustably secured in a plurality of forward and aft locations.

In an embodiment, the resiliently biased tab is resiliently biased toward a mating of the tab and one of plurality of mating holes.

In an embodiment, the sliding step may be accomplished while the headgear is being worn by the wearer.

In an embodiment, the mounting attachment pivotally attaches the visor such that the visor may be operated by the wearer to a down position with the visor generally positioned in front of a face of the wearer and to an up position with the visor generally positioned above the face of the wearer.

In an embodiment, the visor comprises a welding helmet.

DRAWINGS

Figure 6A:
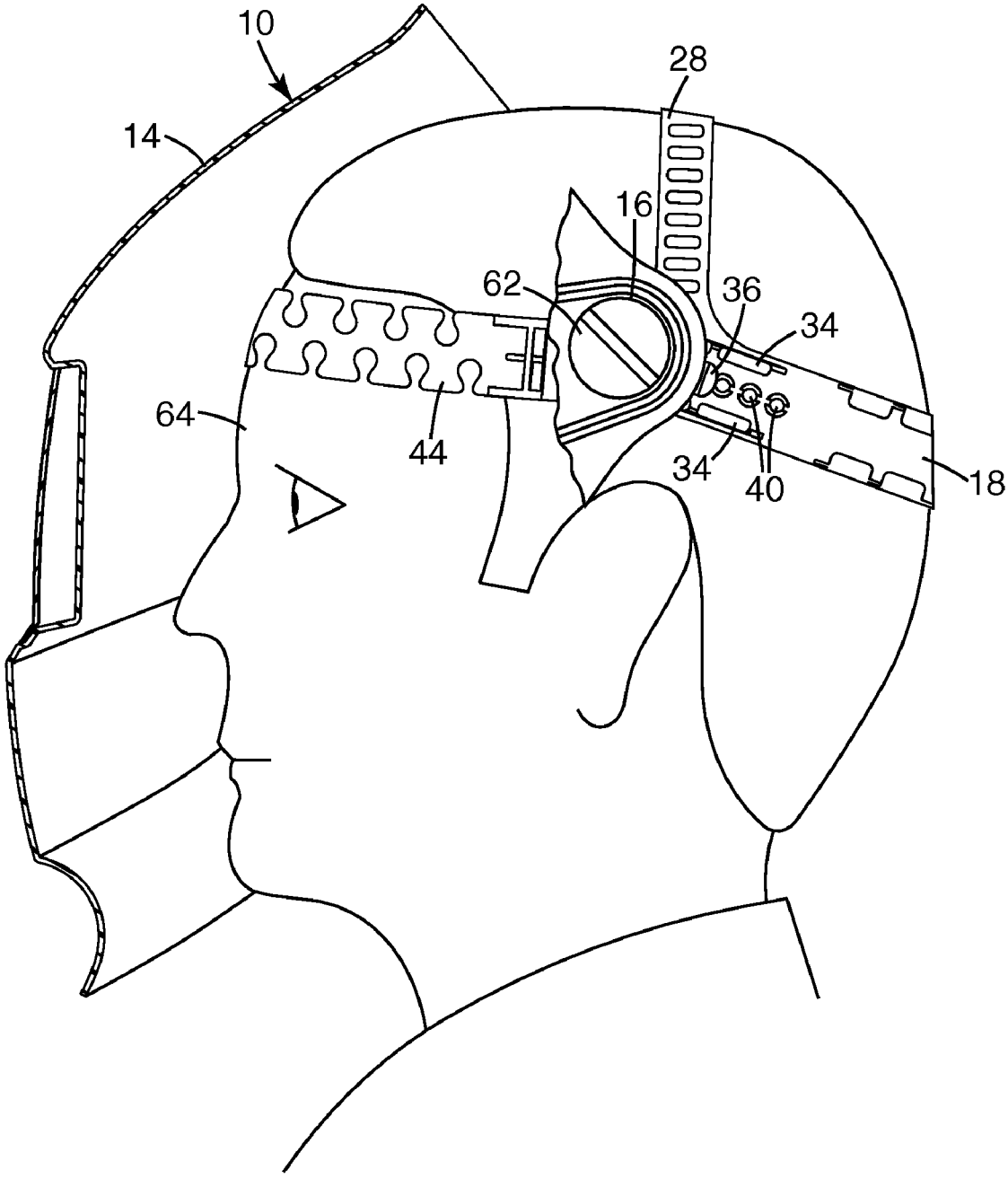
Figure 6B:
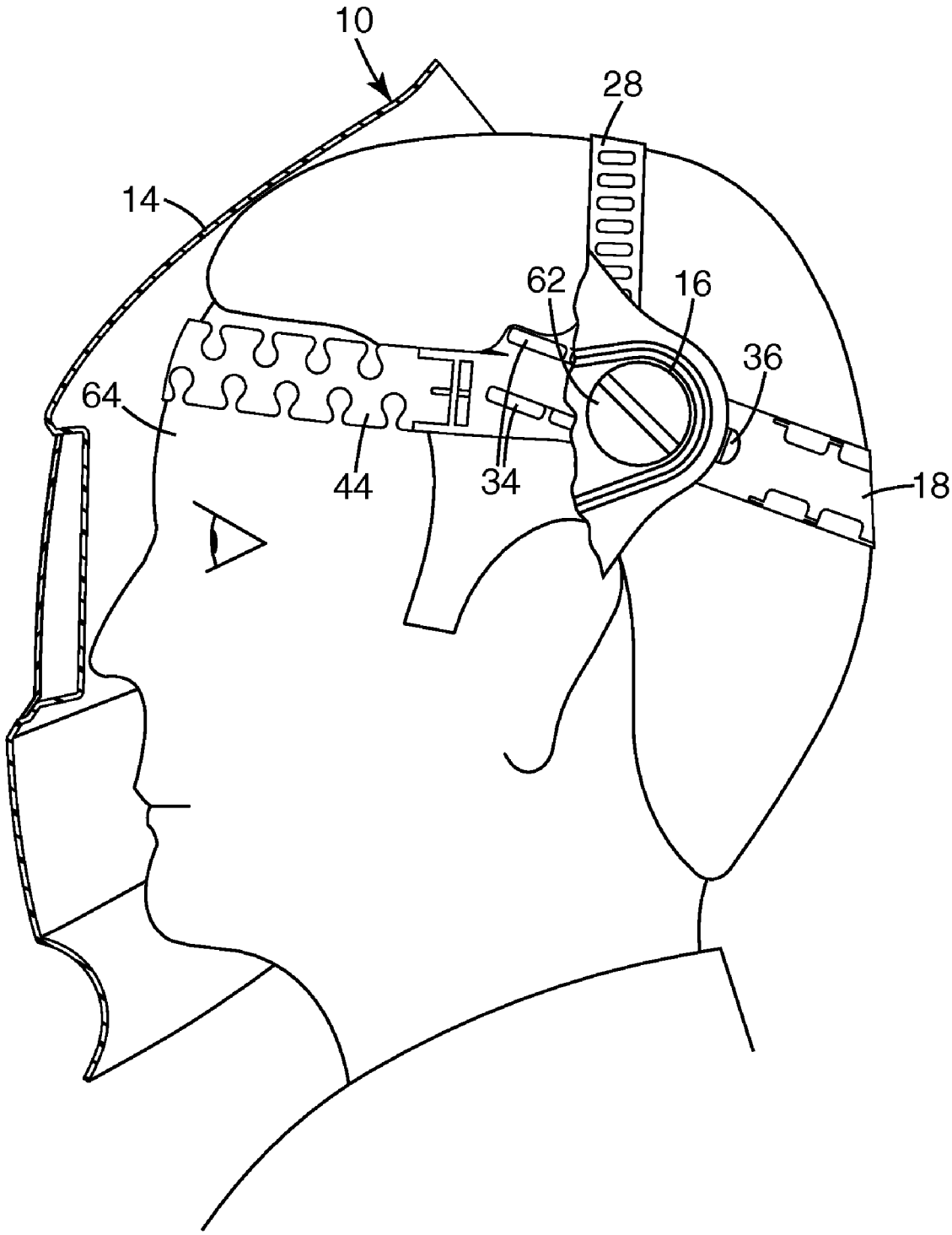

FIG. **6*a* is a partial cross-sectional side view illustrating a visor positioned away from the face of the wearer; and FIG. 6*b*** is a partial cross-sectional side view illustrating a visor positioned toward the face of the wearer.

DETAILED DESCRIPTION

As used in this description, the following terms have the meanings indicated:

"Headgear" means any of a number of generally protective items intended to be worn on or supported by the head of a wearer including, but not limited to, helmets and, in particular, welding helmets.

"Visor" means any of a number of devices that may be used to protect the head, face or neck of a wearer including, but not limited to, visors, face masks and face shields.

"Head suspension system" means the mechanism by which a headgear may be supported by the head of the wearer of the headgear.

"Circumferential band" means the portion of a head suspension system that generally, at least partly, encircles the head of the wearer and supports the head suspension system against the head of the wearer, although such a circumferential band need not actually encircle the head at any particular location and it is not necessary that the circumferential band actually contact the head at a true circumference of the head.

"Anterior portion" means that portion of the head suspension system that generally is positioned toward the forward portion of the head of the wearer of the head suspension system.

"Posterior portion" means that portion of the head suspension system that generally is positioned toward the rear portion of the head of the wearer of the head suspension system.

"Side locations" mean a location or locations that are generally located toward the side of the head of the wearer when the head suspension is positioned normally on the head of the wearer.

"Slide Channel" means a mechanism for receiving a slide in slidable engagement.

"Slide" means any item adapted to slide within a slide channel.

Figure 1:
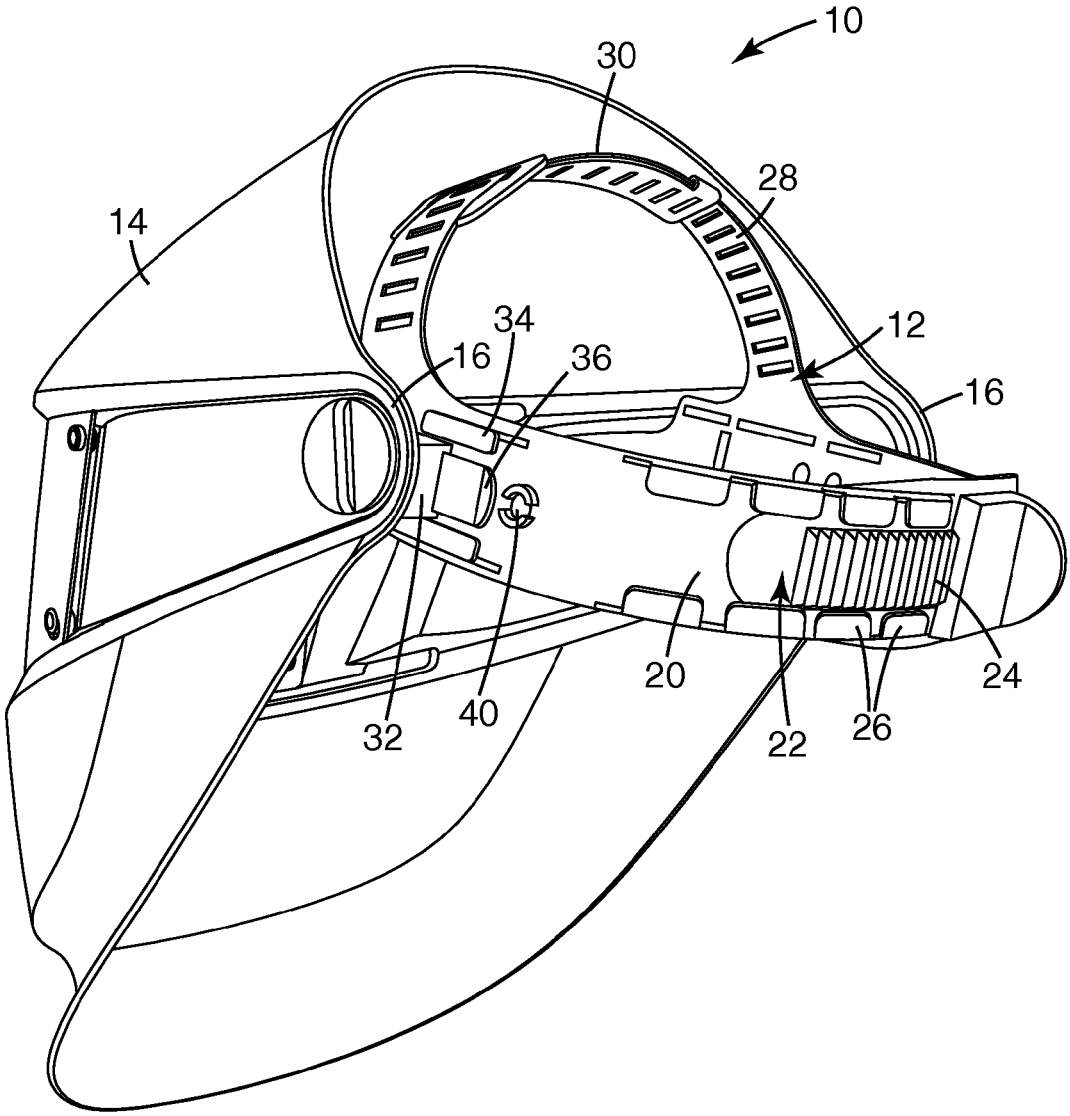
FIG. 1 shows a perspective view of a protective headgear mounted to a head suspension system.

FIG. 1 illustrates a perspective view of a headgear 10 and accompanying head suspension system 12. Visor or face shield 14 is attached to head suspension system 12 at side attachment locations 16. Different types of visors or face shields 14 may be used depending on the intended use of headgear 10. For example, a welding helmet might use a face shield 14 with a protective viewing lens, perhaps replaceable, contained in face shield 14.

Side attachment locations 16 preferably allow visor or face shield 14 to pivot between a down position with visor 14 in front of the face of the wearer in a ready-to-work position and an up position with visor 14 above the head of the wearer allowing an unencumbered view.

Head suspension system 12 consists generally of circumferential band 18 and crown band 20. Circumferential band 18 generally sits on the head of the wearer supporting visor 14 in relation to the head and face of the wearer. Posterior portion 20 of circumferential band 18 contains a fine adjustment mechanism 22 consisting of ratcheting member 24 retained in slide 26 which adjustably secures ends of separate parts of posterior portion 20 together an adjustable manner. An adjustment mechanism such as fine adjustment mechanism 22 is well known in the art.

Head suspension system 12 also contains a "gross" or large adjusting mechanism. Hence, fine adjustment mechanism 22 may be constructed to be smaller and of lighter weight since fine adjustment mechanism doesn't need to accommodate such a large change in size, i.e., length, due to the presence of a separate gross adjustment mechanism.

Head suspension system 12 also has crown band 28 attached to circumferential band 18 and intended to pass over the top of the wearer's head to provide additional support. Slide adjustment mechanism 30 allows crown band 28 to be adjusted for fit.

Slide attachment 32, in this embodiment also serving as an attachment point for visor 14, is secured in circumferential band 18 by slide channel 34. Slide attachment 32 is pivotally coupled with visor 14. Resilient tab 36, coupled with slide attachment, allows visor 14 to be adjusted fore or aft with respect to the face of the wearer while headgear 10 is being worn by the wearer. Resilient tab 36 may be grasped and lifted by the wearer or another so that projection or peg 38 may be disengaged from hole 40 contained on or in circumferential band 18. Once disengaged, resilient tab 36 may easily be maneuvered to slide the slide attachment 32 forward, moving visor 14 outward, or aft, moving visor 14 inward. Resilient tab 36 may release projection or peg 38 into another one of holes 40 securing visor 14 in another position with respect to the face of the wearer. The resilient nature of resilient tab 36 allows projection or peg 38 to be retained in hole 40 until such resilient tab 36 is again lifted and secures visor 14 in a forward/aft position. Visor 14 may still pivot on slide attachment 32.

Figure 2:
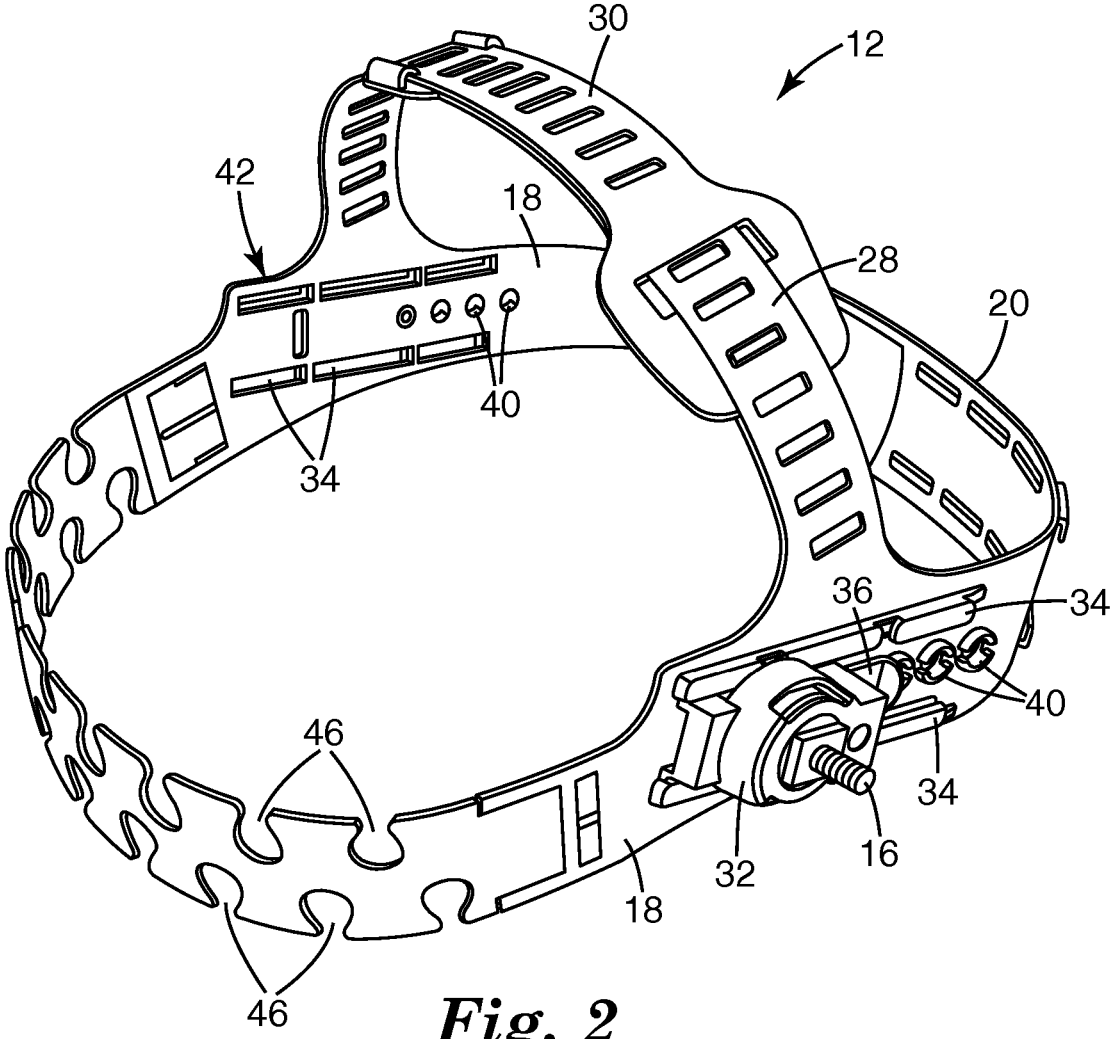
FIG. 2 shows a perspective view of the head suspension system of FIG. 1.

FIG. 2 illustrates head suspension system 12 without visor or face shield 14 installed for greater clarity of head suspension system 12. FIG. 2 provides a better illustration of anterior portion 42 of head suspension system 12 with circumferential band 18. Anterior portion 42 of circumferential band 18 is illustrated with replaceable bridge 44 or one of a plurality of interchangeable bridges 44. Bridge 44 is coupled, at both of its ends, into circumferential band 18. While shown encompassing a majority of anterior portion 42, it is to be recognized and understood that bridge 44 may encompass a smaller or larger part of anterior portion 42. It is also possible that bridge 44 may be accommodated in posterior portion 20 although superior operation and performance are expected with an anterior portion 42 location.

Cut-outs or openings 46, preferably several, many or a multiplicity, in bridge 44 provide additional flexibility of bridge 44 and, hence, circumferential band 18 of which bridge 44 is a part. Such cut-outs or openings 46 also provide additional lightness to circumferential band 18. Although shown as cut-outs 46 extending alternately from opposite sides on bridge 44, it is to be recognized and understood that such cut-outs 46 could extend from only one edge of bridge 44 or cut-outs 46 may instead be openings 46 or holes within bridge 44 not extending to either side edge of bridge 44, or both cut-outs 46 and openings 46 may be used.

Figure 3:
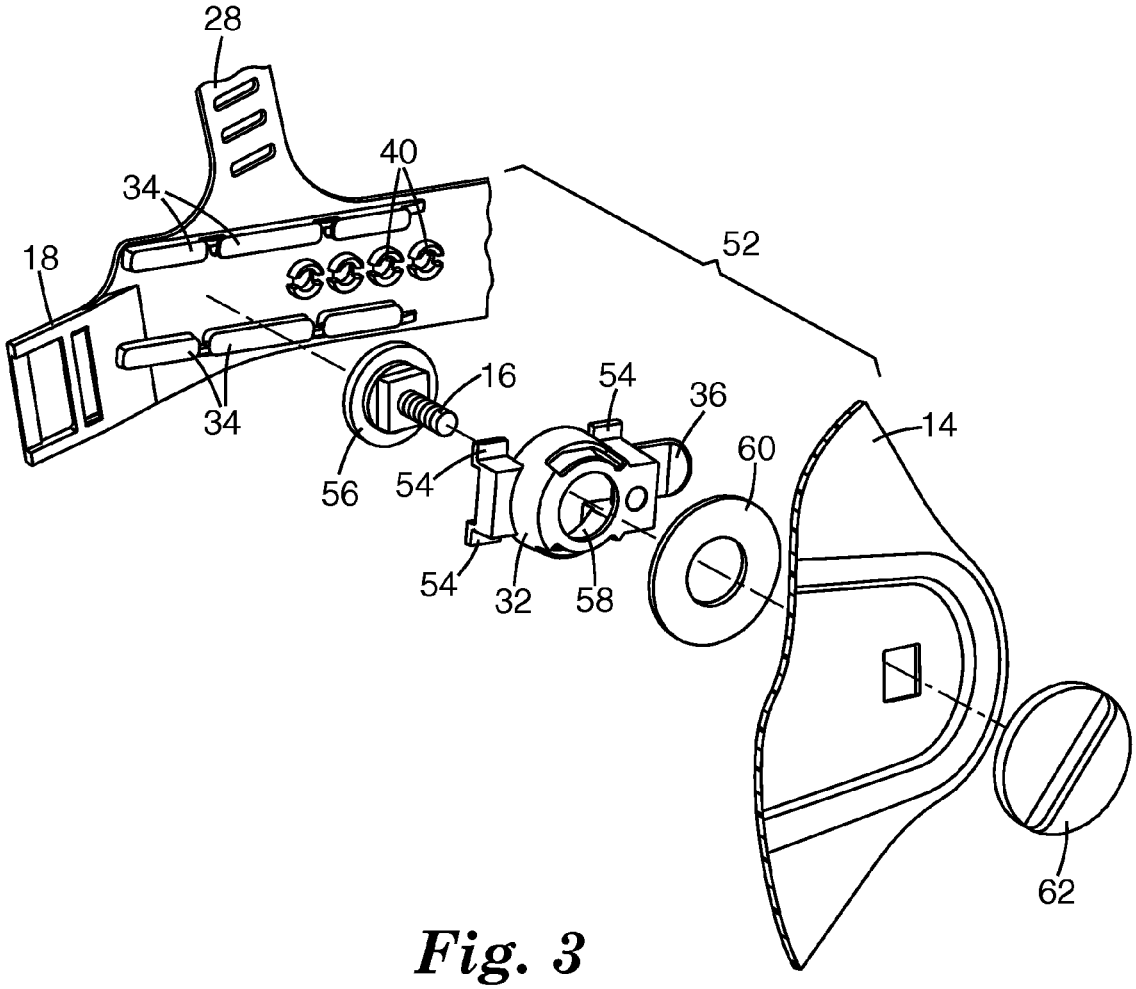
FIG. 3 is an exploded view of the mounting attachment and visor slide mechanism.
Figure 4:
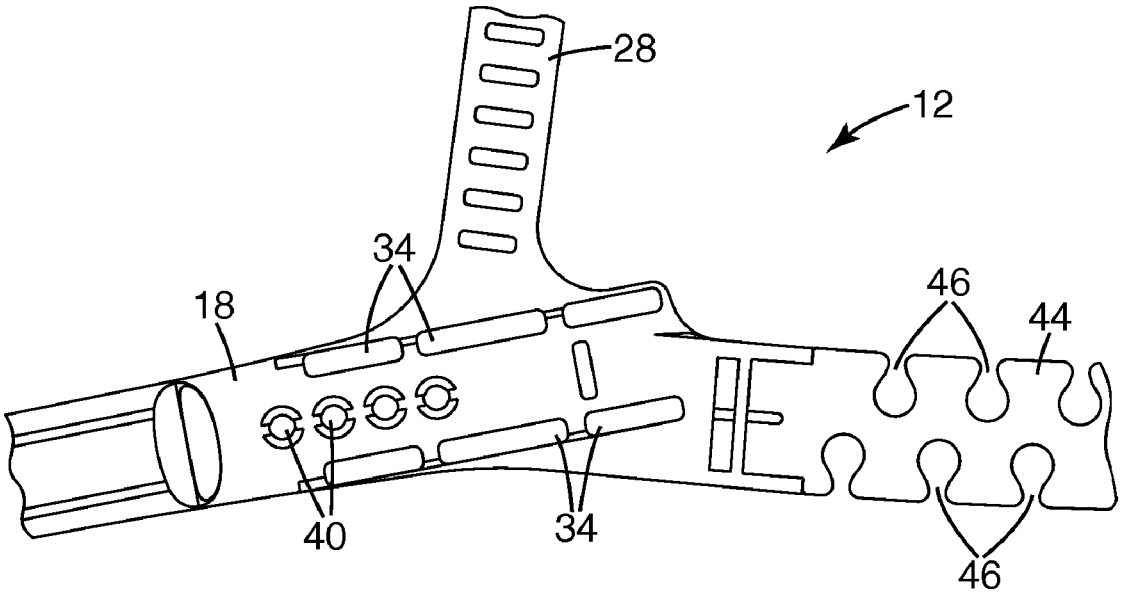
FIG. 4 is a side view of a portion of a circumferential headband illustrating a slide channel.
Figure 5:
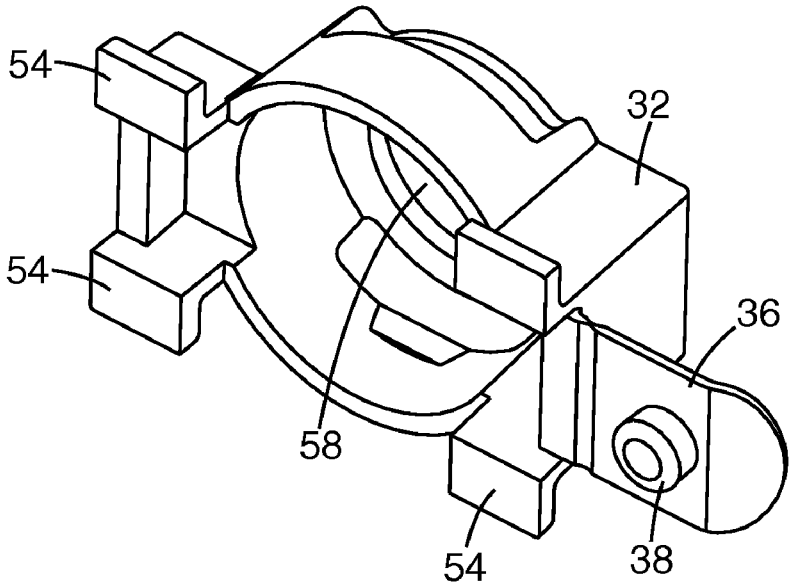
FIG. 5 is a rear perspective view of slide attachment usable with the slide channel illustrated in FIG. 4.

Attachment mechanism 52 may be used to attach visor 14 to circumferential headband 18 and thus to head suspension system 12 at attachment location 16. FIG. 3 is an exploded view of attachment mechanism 52 at side attachment point 16. FIG. 4 illustrates a side view of a portion of circumferential band 18 illustrating side attachment location 16. FIG. 5 is a rear perspective view of slide attachment 32. Together, FIG. 3, FIG. 4 and FIG. 5 provide an illustration of the attachment of visor 14 to head suspension system 12 and the fore and aft slide adjustment mechanism of head suspension system 12.

Slide channels 34 in circumferential band 18 provide a slidable channel into which a mounting attachment for visor 14 may be secured. Slide attachment 32 has tabs 54 which mate with slide channels 34. Stud 56 is fitted through opening 58 in slide attachment 32 and pivotally secures visor 14 to slide attachment 32 with washer 60 and thumb nut 62. Such an arrangement allows visor 14 to pivot while slide attachment 32 remains secured in slide channel 34 of circumferential band 18.

Slide attachment 32 also operates to adjust visor 14 with respect to the face of the wearer. Visor 14 may be moved inwardly toward the face of the wearer by sliding slide attachment 32 in slide channel 34 rearward or aft with respect to the orientation of head suspension system 12 on the head of the wearer. Visor 14 may also be moved outwardly away from the face of the wearer by sliding slide attachment 32 in slide channel 34 forward with respect to the orientation of head suspension system 12 on the head of the wearer.

Projection 38 (illustrated in FIG. 5) engages one of a plurality of holes 40, or detents, in or associated with circumferential band 18 to secure slide attachment 32 in a particular forward/aft position thus essentially locking visor 14 in a particular position inward or away from the face of the wearer. Resilient tab 36 may be lifted, perhaps by the wearer and perhaps while wearing headgear 10, to disengage projection 38 from hole 40. While lifting resilient tab 36, the user may slide the slide attachment 32 along slide channel 34 moving visor 14 with respect to the face of the wearer. When the proper or desired position is obtained, the user may release resilient tab 36 and allow projection 38 to engage another, or perhaps the same, hole 40. The engagement of projection 38 and hole 40 secures attachment slide in a particular position.

Alternatively, slide channels 34 may be associated with said visor and said slide attachment may be associated with said circumferential band 18.

The movement of visor 14 with respect to face 64 of the wearer is illustrated in FIG. 6*a* and FIG. 6*b*. In FIG. 6*a*, projection 38 of slide attachment 32 has been moved to engage hole 40 toward the left in FIG. 6*a*, or toward the front of the head of the wearer. So positioned, visor 14 is positioned well away from face 64 of the wearer. In contrast in FIG. 6*b*, projection 38 of slide attachment 32 has been moved to engage hole 40 toward the right in FIG. 6*b*, or to the rear of the head of the wearer. So positioned, visor 14 is positioned much closer to face 64 of the wearer.

It may be desirable to position visor 14 either farther away from face 64 of the wearer or closer to face 64 of the wearer. Positioning visor 14 closer to face 64 of the wearer may provide the wearer with an expanded field of vision. However, positioning visor 14 farther away from face 64 of the wearer may provide the wearer with increased comfort and lower or decreased fogging. The exact position of visor 14 with respect to face 64 of the wearer may depend upon the preference of the wearer and the particular conditions and/or requirements of the task being undertaken.

Attachment mechanism 52 allows an easy to use, compact and lightweight head suspension system 12. Attachment mechanism 52 may be easily operated by the wearer to move visor 14 in or out while headgear is being worn by the wearer. This not only provides a lightweight, comfortable head suspension system 12 and headgear 10 but also allows the wearer to adjust the position of visor 14 without having to remove headgear 10 from the wearer's head. Removing headgear 10 from the wearer's head would likely require the user to guess at the desired position of visor 14 since the visor would not actually in position on the head of the wearer while the adjustment is being made. This may require multiple removals of headgear 10 and multiple adjustments resulting in a decrease in efficiency.

Thus, embodiments of the invention are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A headgear adapted to protect a wearer, comprising:
a visor; and
a flexible circumferential band adapted to be supported by a head of said wearer;
a mounting attachment attaching said visor to said flexible circumferential band at each of two side attachment locations with said visor generally positioned in front of a face of said wearer;
said mounting attachment comprising:
a slide channel associated with a first headgear part; and
a slide associated with a second headgear part;
said slide being able to slide forward and aft in said slide channel with respect to said face of said wearer;
said slide being selectively securable in a plurality of forward and aft positions;
wherein said mounting attachment has a resiliently biased tab having a projection on one of said slide and said slide channel and another of said slide and said slide channel having a plurality of mating holes such that said slide may be adjustably secured in a plurality of forward and aft locations;
whereby said visor may be adjusted inwardly and outwardly with respect to said face of said wearer.

2. The headgear as in claim 1 wherein said first headgear part comprises said circumferential band and wherein said second headgear part comprises said visor.

3. The headgear as in claim 1 wherein said visor may be adjusted by said wearer inwardly and outwardly with respect to said face of said wearer while said headgear is being worn by said wearer.

4. The headgear as in claim 1 wherein said resiliently biased tab is resiliently biased toward a mating of said tab and one of plurality of mating holes.

5. The headgear as in claim 4 wherein said tab is liftable and said slide is adjustable by said wearer while said headgear is being worn by said wearer.

6. The headgear as in claim 1 wherein said mounting attachment comprises a slide attachment pivotally coupled to said visor such that said visor may be operated by said wearer to a down position with said visor generally positioned in front of a face of said wearer and to an up position with said visor generally positioned above said face of said wearer.

7. The headgear as in claim 1 wherein said visor comprises a welding helmet.

8. A head suspension system for a headgear having a visor adapted to protect a wearer, comprising:
a flexible circumferential band adapted to be supported by a head of said wearer;
a mounting attachment attaching said visor to said flexible circumferential band at each of two side attachment locations with said visor generally positioned in front of a face of said wearer;
said mounting attachment comprising:
a slide channel associated with a first headgear part; and
a slide associated with a second headgear part;
said slide being able to slide forward and aft in said slide channel with respect to said face of said wearer;
said slide being selectively securable in a plurality of forward and aft positions;
wherein said mounting attachment has a resiliently biased tab having a projection on one of said slide and said slide channel and another of said slide and said slide channel having a plurality of mating holes such that said slide may be adjustably secured in a plurality of forward and aft locations;
whereby said visor may be adjusted inwardly and outwardly with respect to said face of said wearer.

9. The head suspension system as in claim 8 wherein said first headgear part comprises said circumferential band and wherein said second headgear part comprises said visor.

10. The head suspension system as in claim 8 wherein said visor may be adjusted by said wearer inwardly and outwardly with respect to said face of said wearer while said headgear is being worn by said wearer.

11. The head suspension system as in claim 8 wherein said resiliently biased tab is resiliently biased toward a mating of said tab and one of plurality of mating holes.

12. The head suspension system as in claim 11 wherein said tab is liftable and said slide is adjustable by said wearer while said headgear is being worn by said wearer.

13. The head suspension system as in claim 8 wherein said mounting attachment pivotally attaches said visor such that said visor may be operated by said wearer to a down position with said visor generally positioned in front of a face of said wearer and to an up position with said visor generally positioned above said face of said wearer.

14. The head suspension system as in claim 8 wherein said visor comprises a welding helmet.

15. A method of adjusting a position of a visor associated with headgear adapted to protect a wearer, said headgear having a mounting attachment for said visor to a head suspension system, said mounting attachment having a slide channel associated with a first headgear part, a slide associated with a second headgear part, said slide being able to slide forward and aft in said slide channel with respect to said face of said wearer, said slide being selectively secured in a plurality of forward and aft positions whereby said visor may be adjusted inwardly and outwardly with respect to said face of said wearer, comprising the steps of:
releasing a tab associated with said slide;
sliding said slide with respect to said slide channel using said tab; and
selectively securing said slide in one of a plurality of forward and aft positions by releasing said tab;
wherein said mounting attachment has a resiliently biased tab having a projection on one of said slide and said slide channel and another of said slide and said slide channel having a plurality of mating holes such that said slide may be adjustably secured in a plurality of forward and aft locations.

16. The method as in claim 15 wherein said first headgear part comprises said circumferential band and wherein said second headgear part comprises said visor.

17. The method as in claim 15 wherein said sliding step may be accomplished while said headgear is being worn by said wearer.

18. The method as in claim 15 wherein said resiliently biased tab is resiliently biased toward a mating of said tab and one of plurality of mating holes.

19. The method as in claim 18 wherein said sliding step may be accomplished while said headgear is being worn by said wearer.

20. The method as in claim 15 wherein said mounting attachment comprises a slide attachment pivotally coupled to said visor such that said visor may be operated by said wearer to a down position with said visor generally positioned in front of a face of said wearer and to an up position with said visor generally positioned above said face of said wearer.

21. The method as in claim 15 wherein said visor comprises a welding helmet.

* * * * *